US006880712B2

(12) United States Patent
Uchida et al.

(10) Patent No.: US 6,880,712 B2
(45) Date of Patent: Apr. 19, 2005

(54) CRANE AND METHOD FOR CONTROLLING THE CRANE

(75) Inventors: Koji Uchida, Hiroshima (JP); Nobuo Yoshioka, Hiroshima (JP); Kanji Obata, Hatsukaichi (JP); Noriaki Miyata, Hatsukaichi (JP); Masaki Nishioka, Hiroshima (JP); Tadaaki Monzen, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 76 days.

(21) Appl. No.: 10/195,387

(22) Filed: Jul. 16, 2002

(65) Prior Publication Data

US 2003/0015489 A1 Jan. 23, 2003

(30) Foreign Application Priority Data

Jul. 18, 2001 (JP) ..... P2001-218502

(51) Int. Cl.[7] ..... B66C 13/08
(52) U.S. Cl. ..... 212/276; 212/270
(58) Field of Search ..... 212/273, 274, 212/275, 270, 276; 294/907

(56) References Cited

U.S. PATENT DOCUMENTS 4,139,107 A * 2/1979 Ninomiya et al. ..... 414/392
4,932,541 A * 6/1990 Belsterling ..... 212/308
4,973,219 A * 11/1990 Brickner et al. ..... 414/792.9
5,089,972 A * 2/1992 Nachman et al. ..... 700/218
5,142,658 A * 8/1992 McMorran et al. ..... 382/104
5,729,453 A * 3/1998 Lee et al. ..... 701/50
5,919,022 A * 7/1999 La Coste ..... 414/137.1
6,081,292 A * 6/2000 Lanigan et al. ..... 348/61
6,124,932 A * 9/2000 Tax et al. ..... 356/614
6,182,843 B1 * 2/2001 Tax et al. ..... 212/274
6,256,553 B1 * 7/2001 Erikkila ..... 700/213
6,644,486 B1 * 11/2003 Jacoff et al. ..... 212/274

FOREIGN PATENT DOCUMENTS

DE 029511254 U1 * 9/1996
DE 195 19741 A1 12/1996
EP 0 440 915 A1 8/1991
JP 5-338985 12/1993
JP 10-120362 5/1998

* cited by examiner

*Primary Examiner*—Thomas J. Brahan
(74) *Attorney, Agent, or Firm*—Armstrong, Kratz, Quintos, Hanson & Brooks, LLP

(57) ABSTRACT

A crane provided with a trolley, a hanging member, a rope member, and a hoisting device. The crane includes a horizontal position displacement detection unit which detects a horizontal positional displacement between at least two corners of the cargo and a landing place of the two corners; and a horizontal position displacement correction unit which corrects a horizontal positional displacement between the at least two corners of the cargo and the landing place of the two corners when the two corners have landed based on a detection signal from the horizontal position displacement detection unit. The horizontal position displacement correction unit corrects the position of a corner of the cargo so that the corner lands at the landing place of the corner, and then corrects the position of another corner so that the corner lands at the landing place of the corner.

13 Claims, 9 Drawing Sheets

CRANE AND METHOD FOR CONTROLLING THE CRANE

BACKGROUND OF THE INVENTION

1. Field of the Invention

The present invention relates to a crane, which is capable of loading and unloading cargoes, such as box-type containers, at harbors, for example, and a method for controlling the crane. More specifically, the present invention relates to a crane and a method for controlling the crane which enables landing of a cargo at a predetermined position with high accuracy in a short period of time.

2. Description of Related Art

The operations of loading containers from a trailer to a ship or unloading of containers from a ship to a trailer is carried out, for example, in harbor yards using cranes.

FIG. 10 is a diagram showing a crane which may be used for the loading and unloading operations.

As shown in FIG. 10, the crane 1 is a bridge crane, which is called a container transfer crane (hereinafter referred to as a "crane") capable of loading a container Ca, which is hoisted by the crane, into a target container Cb.

The crane 1 includes a crane traveling body 2, upper bars 3, a traverse trolley 4, a hanging member 5, rope members 6, and a hoisting device 7. In this crane 1, the traverse trolley 4 moves in the horizontal direction along the upper bars 3 of the crane traveling body 2, and the hanging member 5 called a spreader, which supports the cargo, is hung from the traverse trolley 4 by the rope members 6 so that the hanging member 5 can be raised and lowered by winding and unwinding the rope members 6 using the hoisting device 7 which is disposed at an appropriate position on the traverse trolley 4 or the crane traveling body 2. Also, the cargo may be moved in parallel by moving the transverse trolley 4 along the upper bars 3 of the crane traveling body 2.

When the container Ca, which is the cargo hoisted by the crane 1, is placed on a predetermined target container Cb and stowed, it is necessary to prevent any displacements in the horizontal position between the hoisted container Ca and the target container Cb exceeding an allowable value.

Also, prior to hoisting the container Ca, it is necessary to accurately land the hanging member 5 on the container Ca so as to prevent any horizontal displacements in position exceeding the allowable range. It requires great skill in this type of operation to land the hanging member 5 onto this kind of container Ca within the allowable range of horizontal displacement. It is also a very time consuming operation.

Accordingly, various proposals have been made for techniques to control the stowage of the container, whose main function is the automation of landing operations, and they are disclosed in, for instance, Japanese Unexamined Patent Application, First Publication No. Hei 10-120362, and Japanese Patent No. 2,813,510.

Japanese Unexamined Patent Application, First Publication No. Hei 10-120362 discloses a landing control technique in which the degree of oscillation of the container Ca, which is hung from a crane, from moment to moment is measured using a detector, and the horizontal position of the container Ca is estimated by an operation using the oscillation rate of the hoisted container Ca, which is computed based on the change in the oscillation over time. Also, factors, such as the position, and speed of a transverse trolley, are controlled if necessary. The speed of descent of the hoisted container Ca is adjusted so that the container Ca, the position of which is computed as described above, lands on the predetermined position of the target container Cb with suitable timing so that the shift in position in the horizontal direction falls within the allowable range at the moment the container Ca lands on the target container Cb.

Also, the gist of the landing control technique disclosed in the above-mentioned Japanese Unexamined Patent Application, First Publication No. Hei 10-120362 is to estimate the position of the cargo hung from the crane using a model indicating the dynamic behavior of the hoisted container Ca and the rope members 6.

However, the dynamic model cannot cover all the factors affecting the estimation of the position of the container Ca hung from the crane. In particular, there is a possibility that an error in the estimation of the horizontal positional displacement may be caused due to difficulty in modeling the effect of disturbance. Here, examples of disturbances having a large effect include wind, the weight distribution of the cargo in the container Ca, and unbalanced tension of the rope members 6. The horizontal positional displacement of the hoisted container Ca at landing may exceed the allowable range if such effects are too large.

On the other hand, U.S. Pat. No. 2,813,510 discloses a technique in which a mechanical guide is extended from the bottom of the container Ca so that the container Ca may be positioned on the container Cb along the guide. Although this technique functions to correct the above-mentioned problem of horizontal positional displacement, the weight to be lifted by the hoisting device 7 is increased since the mechanical guide is an attachment to the hanging member 5, and hence, the driving capacity of the hoisting device 7 needs to be increased. Also, mechanical contact of the guide with the target container is inevitable, and therefore, there is the problem that the mechanical guide and the container Cb tend to be easily damaged.

Also, problems in landing errors due to errors in estimating the position of the container Ca hoisted by the crane can be solved, if the degree of positional displacement measured at that time is within the allowable range of landing accuracy, by landing the container Ca before the positional displacement exceeds the allowable range of landing error.

That is, there will be no problem if the time required for landing is shorter than the time over which the degree of positional displacement will exceed the allowable range, by immediately starting the descent of the hoisted container Ca, when the horizontal positional displacement measured at that time is within the allowable range.

However, there is a restriction on the speed of descent of cargo from the viewpoint of safety, to decrease the impact upon landing, and hence, it is necessary for the vertical distance between the container Ca hoisted by the crane and the target container Cb be sufficiently small in order to land the container Ca before the positional displacement exceeds the allowable range.

As an example, assume that the container Ca is hoisted by using the rope member 6, the length of which is 10 meters from the top to the bottom, and the container Ca is lowered to land by winding down the rest of the rope member. Also, assume that the allowable range of horizontal positional displacement is 30 mm. In this state, the cycle of the rope member 6 is about 6.3 seconds ($2\pi\sqrt{(10/9.8)}$). Moreover, assuming that the container Ca is oscillating in the moving direction of the traverse trolley 4 at a half amplitude of 100 mm, the average speed of the container Ca in the horizontal direction is about 63 mm/sec.

Accordingly, if the lowering of the container Ca is started at the moment that the positional displacement between the container Ca and the target container Cb is detected to be zero by a horizontal position displacement detection means, the time for lowering the container Ca needs to be about 0.48 sec or less in order to satisfy the allowable range (30 mm or less) at the landing. That is, Time for lowering=30 mm/63 mm per sec=0.476 sec Here, if the average speed for lowering the container Ca is restricted to 100 mm per sec, the distance between the container Ca and the target container Cb in the height direction needs to be 48 mm or less (i.e., 100 mm/sec×0.48 sec=48 mm).

Prior to landing, if the positional displacement does not fall within the allowable range of landing accuracy, it is necessary to correct the positional displacement or wait for the positional displacement to fall within the allowable range. However, if a correction is made for the positional displacement or if waiting for the positional displacement to fall within a desired range, it is necessary to prevent interference with the movement of the hoisted container Ca by the contact with the target container Cb during that period.

That is, it is necessary that there be vertical space between the container Ca and the target container Cb, and this space must be maintained at the above-mentioned value or less.

In order to maintain the above-mentioned space, it is a prerequisite that the distance between the two containers measurable. There are various methods for measuring the distance between the container Ca and the upper surface of the target container Cb, however, all of them have problems in measuring a distance on the order of the above-mentioned value.

For instance, there is a method in which the position of the hoisted container Ca is detected based on the length of the rope or by using an electro-optical distance meter to obtain the difference between the two provided that the height of the upper surface of the target container Cb is given. However, in practice, errors in the height of the stowage location of the target container Cb, errors in the height of the container, errors caused by stretching of the rope members 6, errors due to structural deformation of the crane 1, etc., accumulate, and it is difficult to carry out a measurement which is satisfactory for the above purpose.

SUMMARY OF THE INVENTION

The present invention takes into consideration the above-mentioned circumstances, and has as an object to provide a crane and a method for controlling the crane by which errors due to the cargo position estimation model in controlling the placement of containers and landing errors (the degree of horizontal positional displacement between the cargo and the target position when landing), which are caused by an accumulation of positional displacement caused by the motion of the cargo in directions other than the direction of the movement of the traverse trolley, are eliminated and the time required for landing is shortened.

Another object of the present invention is to provide a crane and a method for controlling the crane in which space between the cargo and the target is surely provided by a practical method, and the landing operation is completed before the positional displacement between the cargo and the target becomes too large. In addition, according to the crane and the method for controlling the crane, the cargo may be landed in a short period of time satisfying the allowable range of positional displacement without using special equipment which, for instance, is capable of independently controlling right and left supporting ropes in an oscillation controlling process for the cargo even if the cargo is moving in both the moving direction of the trolley and the rotation direction of the cargo.

In order to achieve the above object, the present invention provides a crane having a trolley which is supported in a horizontally movable manner, a hanging member which is hung from the trolley via a rope member and supports a cargo, and a hoisting device which raises and lowers the hanging member by winding and unwinding the rope member, the crane being used to land the cargo supported by the hanging member to a predetermined landing place, comprising: a horizontal position displacement detection unit which detects a horizontal positional displacement between at least two corners, a first corner and a second corner, of four corners of the cargo and a position relating to the landing place of each of the first corner and the second corner; and a horizontal position displacement correction unit which corrects a horizontal positional displacement between the at least two corners, the first corner and the second corner, of the cargo and the position relating to the landing place of each of the first corner and the second corner when the first corner and the second corner, respectively, are landed based on a detection signal from the horizontal position displacement detection unit, wherein the horizontal position displacement correction unit corrects the position of the first corner of the cargo, in a state where the first corner of the cargo supported by the hanging member is lowered relative to the other corners of the cargo by inclining the hanging member, so that the first corner of the cargo lands at the position relating to the landing place of the first corner, and then the horizontal position displacement correction unit corrects the position of the second corner so that the second corner lands at the position relating to the landing place of the second corner.

In the above, the term "position relating to the landing place of a specific corner of a cargo" means, for instance, a corner of a container stowed on the ground, which corresponds to the specific corner of the cargo, for the case where the landing place is on a container stowed on the ground.

Also, when a hoisted cargo is landed at a predetermined place on the ground, the term "position relating to the landing place of a specific corner of a cargo" means, for instance, a mark provided for specifying the position of the predetermined landing place on the ground, which is disposed so that the cargo can be landed at the a predetermined position by positioning the mark and the specific corner of the cargo so as to have a predetermined positional relationship.

Examples of the above-mentioned horizontal position displacement correction unit include a means in which the trolley is moved so as to decrease the degree of horizontal position displacement based on a detection signal from the horizontal position displacement detection unit, a means in which a similar correction is made by rotating the hanging member using a rotation device if such a device is provided, and a means in which the trolley is moved as above and the rotation device is also employed.

The present invention also provides a crane provided with a trolley which is supported in a horizontally movable manner, a hanging member which is hung from the trolley via a rope member and supports a cargo, and a hoisting device which raises and lowers the hanging member by winding and unwinding the rope member, the crane being used to land the cargo supported by the hanging member at a predetermined landing place, comprising: a horizontal position displacement detection unit which detects a horizontal positional displacement between at least two corners, a first corner and a second corner, of four corners of the cargo and a position relating to the landing place of each of the first corner and the second corner; and a horizontal position displacement correction unit which corrects a horizontal positional displacement between the at least two corners, the first corner and the second corner, of the cargo and the position relating to the landing place of each of the first corner and the second corner when the first corner and the second corner, respectively, are landed based on a detection signal from the horizontal position displacement detection unit, wherein the horizontal position displacement correction unit corrects the position of the first corner of the cargo, in a state where a side including the first corner of the cargo supported by the hanging member is lowered relative to other sides of the cargo by inclining the hanging member, so that the side including the first corner of the cargo lands on the position relating to the landing place of the first corner, and then the horizontal position displacement correction unit corrects the position of another side including the second corner of the cargo so that the second corner lands on the position relating to the landing place of the second corner.

The present invention also provides a method for controlling a crane provided with a trolley which is supported in a horizontally movable manner, a hanging member which is hung from the trolley via a rope member and supports a cargo, and a hoisting device which raises and lowers the hanging member by winding and unwinding the rope member, the crane being used to land the cargo supported by the hanging member to a predetermined landing place, comprising the steps of: a lowering step in which one of the corners, a first corner, of the cargo supported by the hanging member is lowered relative to the other corners of the cargo by inclining the hanging member; a first positioning step in which the horizontal position of the first corner is determined with respect to a position relating to the landing place of the first corner; a first landing step in which the first corner is made to contact the landing place by lowering the cargo using the hoisting device in a state where the first corner is positioned at the position relating to the landing place of the first corner; a second positioning step in which the position of at least one of the other corners, a second corner, of the cargo in a horizontal direction is determined with respect to a position relating to the landing place of the second corner after the first landing step; and a second landing step in which the second corner and the rest of corners are made contact the landing place by lowering the cargo using the hoisting device in a state where the second corner is positioned with respect to the position relating to the landing place of the second corner so that the entire bottom surface of the cargo lands on the landing place.

The present invention also provides a method for controlling a crane provided with a trolley which is supported in a horizontally movable manner, a hanging member which is hung from the trolley via a rope member and supports a cargo, and a hoisting device which raises and lowers the hanging member by winding and unwinding the rope member, the crane being used to land the cargo supported by the hanging member at a predetermined landing place, comprising the steps of: a lowering step in which one of the sides including a first corner of the cargo supported by the hanging member is lowered relative to the other sides of the cargo by inclining the hanging member; a first positioning step in which the horizontal position of the first corner is determined with respect to a position relating to the landing place of the first corner; a first landing step in which the side including the first corner is made to contact the landing place by lowering the cargo using the hoisting device in a state where the first corner is positioned at the position relating to the landing place of the first corner; a second positioning step in which the horizontal position of the other side including a second corner opposite the side including the first corner of the cargo is determined with respect to a position relating to the landing place of the second corner after the first landing step; and a second landing step in which the side including the second corner of the cargo is made to contact the landing place by lowering the cargo using the hoisting device in a state where the second corner is positioned with respect to the position relating to the landing place of the second corner so that the entire bottom surface of the cargo lands on the landing place.

The present invention also provides a method for controlling a crane provided with a trolley which is supported in a horizontally movable manner, a hanging member which is hung from the trolley via rope members and supports a cargo, and a hoisting device which raises and lowers the hanging member by winding and unwinding the rope members, the crane being used to land the cargo supported by the hanging member at a predetermined landing place, comprising the steps of: an adjusting step in which the length of the rope members is adjusted so that one of the corners, a first corner, of the cargo supported by the hanging member is lowered relative to the other corners of the cargo when the cargo is hoisted by using the hoisting device; a hoisting step in which the corners of the cargo other than the first corner are separated from a place where the cargo has been placed by winding up the hanging member using the hoisting device; a positioning step in which the position of at least one of the other corners, a second corner, of the cargo in a horizontal direction is determined with respect to a position relating to the landing place of the second corner after the hoisting step; and a landing step in which the second corner together with the rest of corners are made to contact the landing place by lowering the cargo using the hoisting device in a state where the second corner is positioned with respect to the position relating to the landing place of the second corner so that the entire bottom surface of the cargo lands on the landing place.

The present invention also provides a method for controlling a crane provided with a trolley which is supported in a horizontally movable manner, a hanging member which is hung from the trolley via rope members and supports a cargo, and a hoisting device which raises and lowers the hanging member by winding and unwinding the rope members, the crane being used to land the cargo supported by the hanging member at a predetermined landing place, comprising the steps of: an adjusting step in which the length of the rope members is adjusted so that one of the sides including a first corner of the cargo supported by the hanging member is lowered relative to the other sides of the cargo when the cargo is hoisted by using the hoisting device; a hoisting step in which the other side of the cargo opposite the side including the first corner is separated from a place where the cargo has been placed by winding up the hanging member using the hoisting device; a positioning step in which the position of a corner of the side of the cargo separated from the place where the cargo has been placed is determined with respect to a position relating to the landing place of the second corner after the hoisting step; and a landing step in which the side including the second corner of the cargo is made to contact the landing place by descending the cargo using the hoisting device in a state where the second corner is positioned with respect to the position relating to the landing place of the second corner so that the entire bottom surface of the cargo lands on the landing place.

In another aspect of the present invention, the above method for controlling a crane further includes the step of: a hoisting stop step in which a rope member supporting point on the trolley and a rope member supporting point on the hanging member are shifted in the horizontal direction prior to the hoisting step, and hoisting of the hanging member is stopped when the movement of the cargo due to a positional displacement of the rope supporting points in the horizontal direction is detected in the hoisting step.

In yet another aspect of the present invention, in the above method for controlling a crane, the landing place is an upper surface of a container and the cargo is landed and stowed on the container.

According to the crane and the method for controlling the crane described above, the height of one of the corners at the bottom of the cargo, such as a container, is lowered relative to the height of the other corners by using an appropriate method, for instance, a method in which the length of one of the rope members (of which there are usually four) is adjusted to be longer than the others, or a method using hanging member inclining devices which incline the cargo in the back and forth, and right and left directions (respectively referred to as a heeling device, and a trimming device), and a horizontal position displacement between the corner whose height is lowered (hereinafter referred to as the corner A in contrast with the other corner which is referred to as the corner B) and a corner of the upper surface of a target container is measured and the predicted shift thereof is estimated by considering only the horizontal position displacement. The hoisted cargo is lowered so that the corners make contact and the cargo is landed when the horizontal position displacement enters the allowable range by moving the trolley or rotating the cargo, if a rotation device for the cargo is provided, as necessary, so as to decease the positional displacement between the corners.

A means for individually detecting the fact that each corner of the hoisted cargo has landed (a landing detection means) is provided for the hanging member to detect the landing of the corner A. When the corner A has landed, the corner A is supported by the corresponding corner of the target container, and the other corner (corner B) can be rotated about the corner A using the corner A as a supporting point while maintaining a space corresponding to the relative vertical distance (height) between the corner A and the corner B with respect to the target container. This state is indicated in FIG. 8. In FIG. 8, it is shown that the corner A of the hoisted container Ca has landed on the corresponding corner Cb of the target container Cb, and the other corners of the container Ca have not landed. Note that the same effect can be obtained if one of the shorter bottom sides of the hoisted container Ca lands instead of the one corner of the container Ca, as shown in FIG. 9.

Then, subsequent to the detection of the landing of the corner A, the hoisted container Ca is landed using the same method for the corner A by considering the horizontal position displacement between the corner B which has not landed and the corresponding corner of the target container Cb. Since the container is assumed to be of the box type (i.e., a rectangular parallelopiped shape), the whole container Ca lands on the target container Cb within an allowable range of positional displacement if two corners thereof land so as to be within the allowable range. In such a case, the container Ca can be landed within the allowable range without being affected by errors in estimating the positional displacement if the relative difference between the corner A and the corner B is sufficiently small as mentioned above.

The effect generated by carrying out a landing control by considering only a horizontal position displacement between the hoisted container Ca and the corresponding corner of the target container Cb, other than the one mentioned above, is that the cargo Ca can be landed so as to satisfy the allowable range even if the hoisted container Ca is affected by the movement of the trolley or is rotated, if an amount corresponding to the sum of a moving direction component of the trolley in the rotation motion and the movement of the moving direction of the trolley is decreased or the container Ca is landed with a timing such that the amount enters the allowable range.

That is, correction can be made using the movement of the trolley or a rotation device if such a device is provided, and hence, the control becomes easy. In the case if attempting to bring displacement of a plurality of corners due to a rotation motion within an allowable range at the same time, it is extremely difficult to correct the positional displacement for all of the plurality of corners at the same time since the motion of a corner due to the rotation movement will be in the opposite direction for the corner at the other side of the container.

FIG. 5 is a diagram showing the relationship of the horizontal position displacement between the movement of the hoisted container Ca and the target container Cb.

It is possible to approximate the horizontal position displacement of the hoisted container Ca with respect to the target container Cb, considering the corner A of the hoisted container Ca, by adding a positional displacement DL, which is parallel to the moving direction of the trolley, to a shift DS, which is a moving direction component of the trolley shifted by the rotation.

Note that it is possible, in practice, to suppress the rotation motion to about 2° at maximum. Hence, assuming the length of the container in the longitudinal direction (i.e., the length orthogonal to the moving direction of the transverse trolley) is 12 meters, the degree of shift of the container Ca due to the rotation in the orthogonal direction with respect to the moving direction of the trolley becomes about 4 meters, and this can be neglected in practice. Accordingly, it is in practice appropriate to approximate the degree of movement due to the rotation using the moving direction component of the trolley.

Also, a stable landing control easily becomes possible by landing and holding only the corner A first as mentioned above, and then carrying out a control process for the positional displacement and a landing process by considering only the other free corner B.

That is, for the case where the corner A has not landed and cannot be used as a supporting point for moving the corner B, this leads to a positional displacement of the other corner if it is attempted to control the positional displacement by considering one corner, and hence it eventually becomes difficult to achieve the object of landing all of the corners of the container Ca on the corresponding corners of the target container Cb so as to fall within the allowable range of positional displacement.

In the above-mentioned case, if the corner A, the height of which is set to be lower than the height of the other corners, cannot be landed so as to satisfy the allowable range of positional displacement for some reason, the cargo is raised again and the ascent is stopped when the landing detection means for the corner A detects that the corner A is separated from the target container Cb. After this, the landing control process is performed again. In this case, if the hoisted container Ca is lowered when it is detected that the distance between the corner A and the target container Cb is sufficiently small and the displacement between the corner A and the corresponding corner B of the target container Cb is within the allowable range, it becomes possible to complete the landing process for the container Ca before the positional displacement becomes too large.

On the other hand, if it is detected, after the landing of the entire container Ca, that the degree of displacement at landing does not fall within the allowable range for some reason, the landing control is carried out again, for either the case that the corner A has landed within the allowable range or the case where the corner A has not landed within the allowable range.

1) The corner A has landed within the allowable range:

The container is hoisted. Since the height of the corner A is set to be lower than the height of the corner B, the corner A is still in the landing state if the hoisting process is stopped when it is detected that the corner B is separated from the target container Cb. Accordingly, the whole container Ca is landed by carrying out a landing control for the corner B as mentioned above.

2) The corner A has not landed within the allowable range:

The container is hoisted until it is detected that the corner A is separated from the target container Cb. At that time, since the height of the corner A is set to be lower than the height of the corner B, the corner B is also detached from the target container Cb. Then, the whole container Ca is landed by carrying out the above mentioned landing control process for the corner A and then subsequently for the corner B.

As explained above, according to the crane and the method for controlling the crane according to the present invention, cargo may be landed on a landing place or stowed on another container by securely horizontally positioning the cargo without using an additional device such as a special mechanical guide even when the hoisted cargo is moved in the moving direction of the trolley and is rotated.

Also, a cargo, such as a container, may be landed on a landing place or stowed on another container within a short period of time without adding any special device for the crane or waiting for the movement of the cargo to stop even if the container is moved in the moving direction of the trolley and is rotated.

Moreover, the container may be stowed on a landing place or landed on another container in a stable manner without being affected by errors in positional estimation due to disturbances, such as wind and offset load of the hoisted container, with the landing control method of the position estimation of the hoisted container.

These inventions are extremely effective in realizing a stable and efficient automated stowage system for the crane with low cost.

BRIEF DESCRIPTION OF THE DRAWINGS

Some of the features and advantages of the invention having been described, others will become apparent from the detailed description which follows, and from the accompanying drawings, in which.

DETAILED DESCRIPTION OF THE INVENTION

The invention summarized above and defined by the enumerated claims may be better understood by referring to the following detailed description, which should be read with reference to the accompanying diagrams. This detailed description of a particular preferred embodiment, set out below to enable one to build and use one particular implementation of the invention, is not intended to limit the enumerated claims, but to serve as a particular example thereof.

A crane and a method for controlling the crane according to embodiments of the present invention will be described with reference to drawings.

First, the entire structure of a transfer crane to which the controlling method according to the present invention is applied will be explained.

Figure 1:
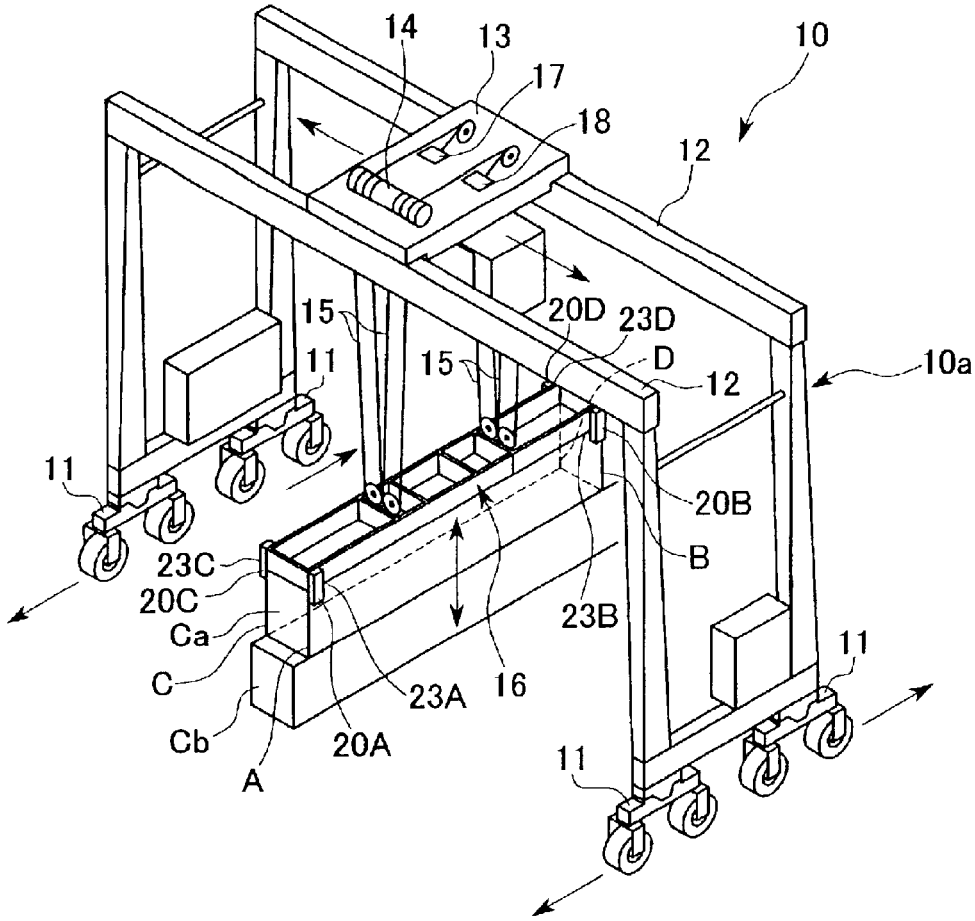
FIG. 1 is a diagram showing a perspective view of a crane according to an embodiment of the present invention to explain the structure and elements thereof.

FIG. 1 is a diagram showing a container transfer crane 10 (hereinafter referred to as a "crane") which hoists and places a container Ca onto a target container Cb.

The crane 10 is a bridge type crane provided with wheels, which stacks the containers, and the crane 10 includes a crane traveling body 10*a* of a gate shape which can travel over a railless surface by means of a wheel type traveling device 11. The crane traveling body 10*a* includes horizontal upper bars 12, and a traverse trolley 13, which moves in a horizontal direction along the upper bars 12, is disposed at the upper bars 12.

A hoisting device 14 is provided with the traverse trolley 13, and a hanging member 16 (a spreader) for the container is hung from the hoisting device 14 by using four rope members 15 which are wound and unwound by the hoisting device 14.

The hanging member 16 can detachably support the container Ca. In this embodiment, the container Cb is the target container, and the case where the container Ca is landed onto the target container Cb and stowed is shown.

The transverse trolley 13 is provided with hanging member inclining devices 17 and 18 comprising a heeling device and a trimming device which incline the container Ca in the back and forth and right and left directions by changing the length of the four rope members 15. The hanging member inclining devices 17 and 18 have a mechanism by which the position of a supporting point of the rope members 15 on the transverse trolley 13 is changed by using an electric cylinder, and the hanging member 16 may be inclined by changing the supporting point in this manner.

Also, horizontal position displacement detectors 20A, 20B, 20C, and 20D, which detect the position of the target container Cb or the position for stowing containers on the ground, i.e., marks showing a position relating to the landing place, relative to four corners, A, B, C, and D, of the container Ca are provided.

An example of the horizontal position displacement detectors 20A, 20B, 20C, and 20D includes a detector provided with a CCD camera which views the bottom surface of the container Ca and the upper surface of the target container Cb at the same time, and detects the edges of the two containers by treating the image data obtained to detect the horizontal positional displacement between the container Ca and the target container Cb based on the relative positional relationship of the edges.

Also, landing detectors 23A, 23B, 23C, and 23D for the container Ca are disposed at four corners, A, B, C, and D, respectively, of the hanging member 16.

Figure 2A:
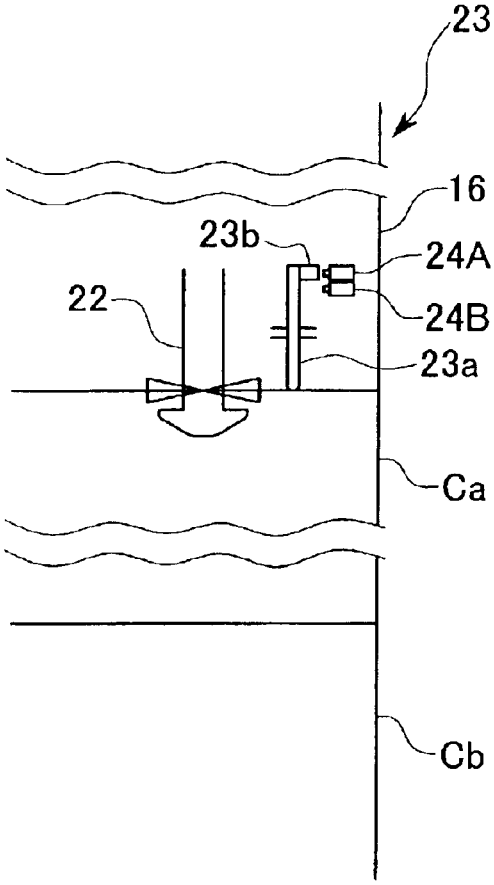
FIGS. 2A and 2B are schematic diagrams showing cross-sectional views in the vicinity of a hanging member for explaining a landing detector for detecting a hoisted container provided with a crane according to an embodiment of the present invention.
Figure 2B:
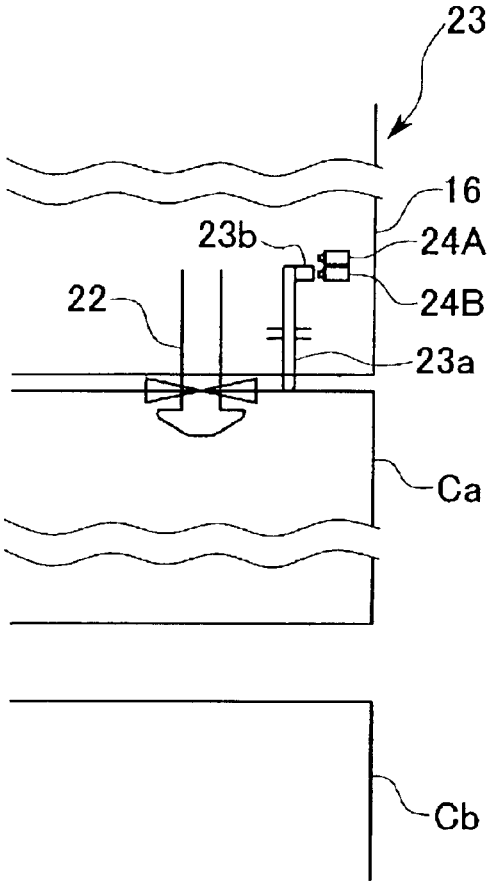

The landing detectors 23A, 23B, 23C, and 23D, respectively, as shown in FIGS. 2A and 2B (indicated by the numeral 23), include a rod 23*a*, an actuator 23*b*, and proximity switches 24A and 24B attached to the hanging member 16. The rod 23*a* is attached slidably in the up and down direction, and the proximity switches 24A and 24B are actuated by the actuator 23*b*, which is attached to the upper portion of the rod 23*a*.

When the rod 23*a* is at the upper position, the proximity switch 24A is turned ON, and when the rod 23*a* is at the lower position, the proximity switch 24B is turned ON.

In this embodiment, FIG. 2A shows a state in which the container Ca has landed on the target container Cb, and the rod 23*a* is located at the upper position to turn on the proximity switch 24A. Also, FIG. 2B shows a state in which the hoisted container Ca has not landed on the target container Cb, and the rod 23*a* is located at the lower position to turn on the proximity switch 24B.

Note that in FIGS. 2A and 2B, the numeral 22 indicates a twist lock pin and the twist lock pin 22 is used to engage the container Ca with the hanging member 16.

Next, the control system for the crane 10 having the above-mentioned structure will be explained in detail.

Figure 3:
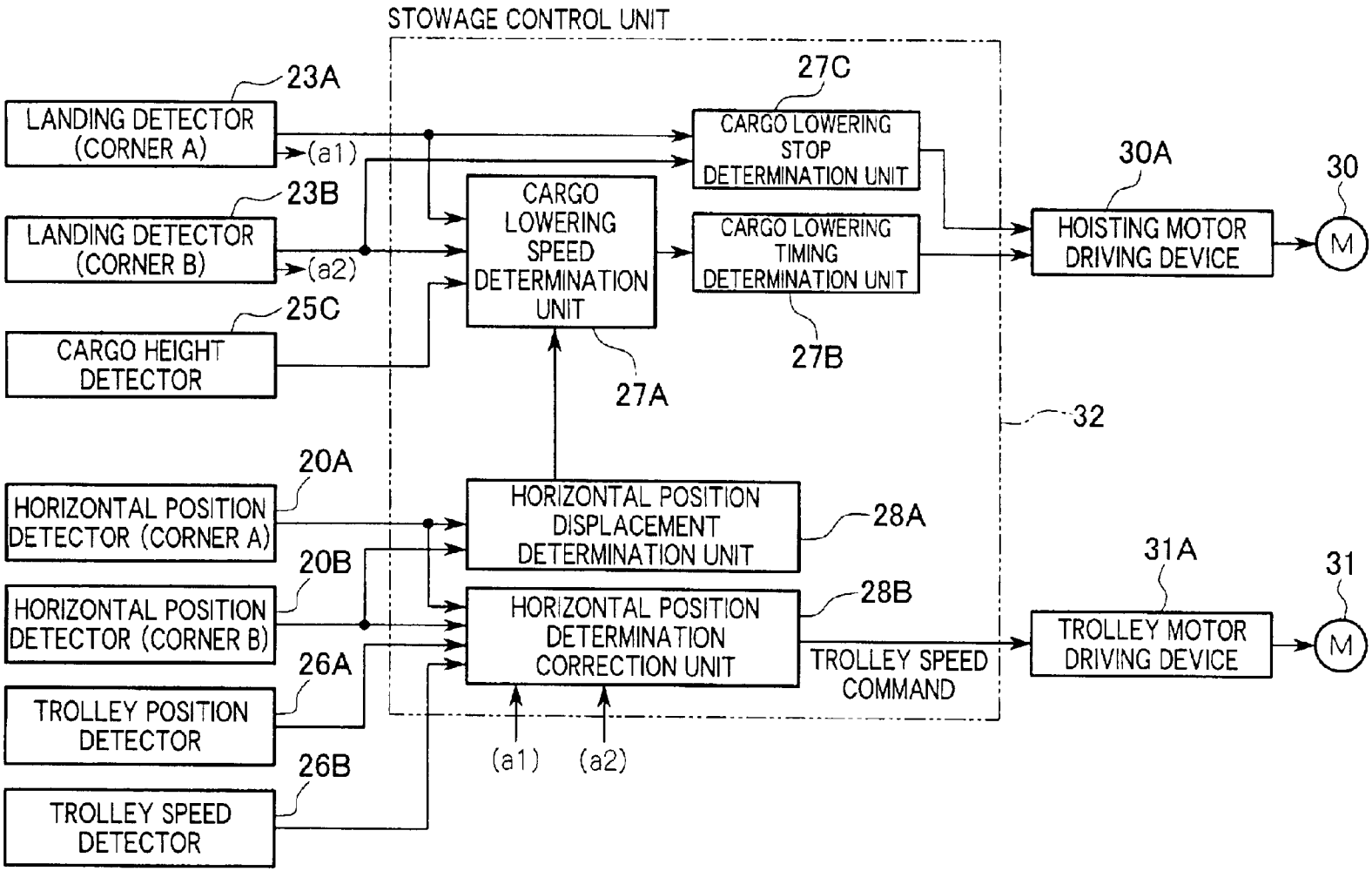
FIG. 3 is a block diagram for explaining function of a control system of a crane according to an embodiment of the present invention.

FIG. 3 is a diagram showing a control system for controlling the stowage operation by the crane 10.

In FIG. 3, the numeral 32 indicates a stowage control unit, and a hoisting motor 30 for actuating the hoisting device 14 via a hoisting motor driving device 30A is connected to the stowage control unit 32.

Also, a trolley driving motor 31 for actuating the transverse trolley 13 in the transverse direction via a trolley motor driving device 31A is connected to the stowage control unit 32.

Moreover, the landing detector 23A which corresponds to the corner A of the container Ca and the landing detector 23B which corresponds to the corner B of the container Ca are connected to the stowage control unit 32. Further, a hoisted cargo height detector 25C, which includes a rotary encoder provided with the hoisting motor 30 for actuating the hoisting device 14, is connected to the stowage control unit 32.

In addition, the horizontal position displacement detectors 20A and 20B as well as a trolley position detector 26A for detecting the position of the transverse trolley 13 and a trolley speed detector 26B for detecting the moving speed of the transverse trolley are connected to the stowage control unit 32.

Also, the stowage control unit 32 includes a horizontal position displacement determination unit 28A and a horizontal position displacement correction unit 28B. The horizontal position displacement determination unit 28A determines if the horizontal positional displacement between the corners A and B of the container Ca and between the corners A and B of the target container, respectively, are within the allowable range based on signals from the horizontal position displacement detectors 20A and 20B. The horizontal position displacement correction unit 28B controls the actuation of the trolley driving motor 31 by outputting a trolley speed command signal to the trolley motor driving device 31 A based on signals from the horizontal position displacement detectors 20A and 20B, the trolley position detector 26A, and the trolley speed detector 26B so that the horizontal positions of the corners A and B of the container Ca match the corners A and B of the target container Cb.

Moreover, the stowage control unit 32 includes a hoisted cargo lowering speed determination unit 27A and a hoisted cargo lowering timing determination unit 27B. The hoisted cargo lowering speed determination unit 27A determines the lowering speed of a hoisted cargo in order to lower the hoisted container Ca at the required speed based on signals transmitted from the landing detectors 23A and 23B, the hoisted cargo height detector 25C, and the horizontal position displacement determination unit 28A. The hoisted cargo lowering timing determination unit 27B determines the timing for lowering the container Ca at the lowering speed determined by the hoisted cargo lowering speed determination unit 27A. The hoisted cargo lowering timing determination unit 27B outputs a signal for commanding an actuation to the hoisting motor driving device 30A so that the hoisted container Ca, which is supported by the hanging members 16, is lowered at the speed and timing determined by the hoisted cargo lowering speed determination unit 27A and a hoisted cargo lowering timing determination unit 27B, respectively, via the hoisting motor 30.

Further, the stowage control unit 32 includes a hoisted cargo lowering stop determination unit 27C which determines the timing to stop lowering the container Ca based on signals from the landing detectors 23A and 23B. The hoisted cargo lowering stop determination unit 27C outputs a signal commanding an actuation to the hoisting motor driving device 30A so that the hoisting motor 30 is stopped at the timing determined by the hoisted cargo lowering stop determination unit 27C in order to stop the lowering of the container Ca supported by the hanging member 16.

Figure 4A:
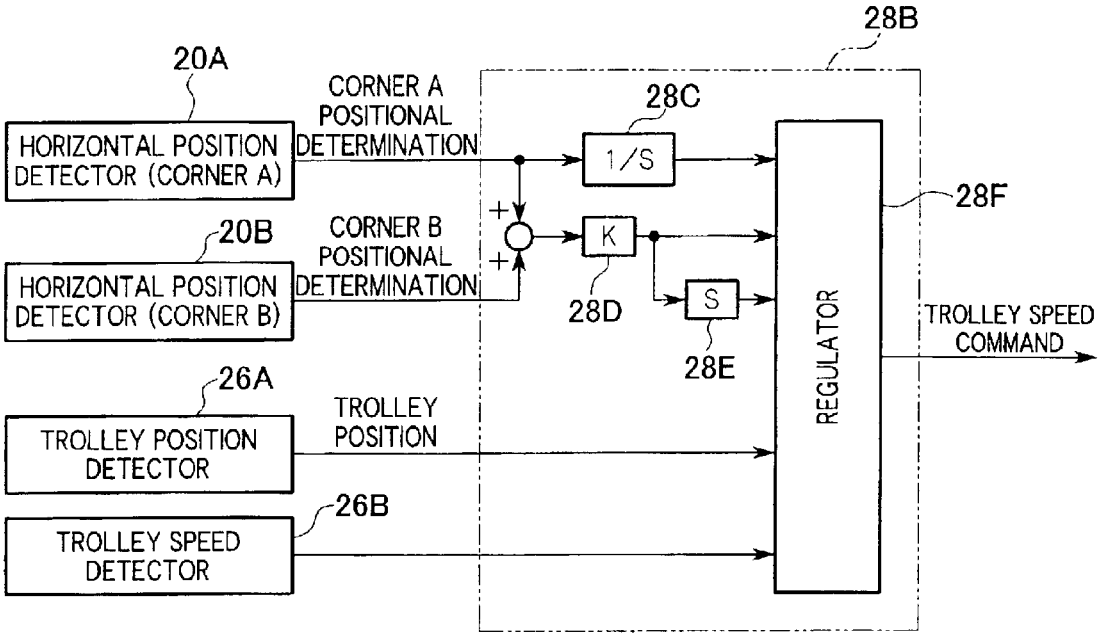
FIGS. 4A and 4B are block diagrams for explaining control of a control system of a crane according to an embodiment of the present invention.
Figure 4B:
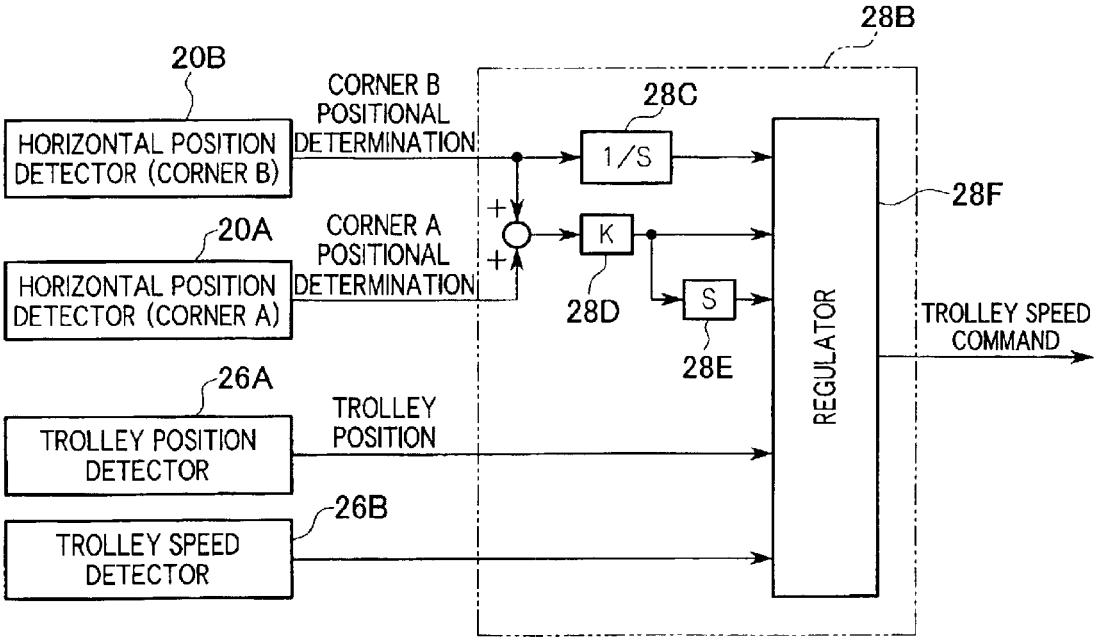

FIGS. 4A and 4B are diagrams for explaining function of the horizontal position displacement correction unit 28B shown in FIG. 3.

Figure 5:
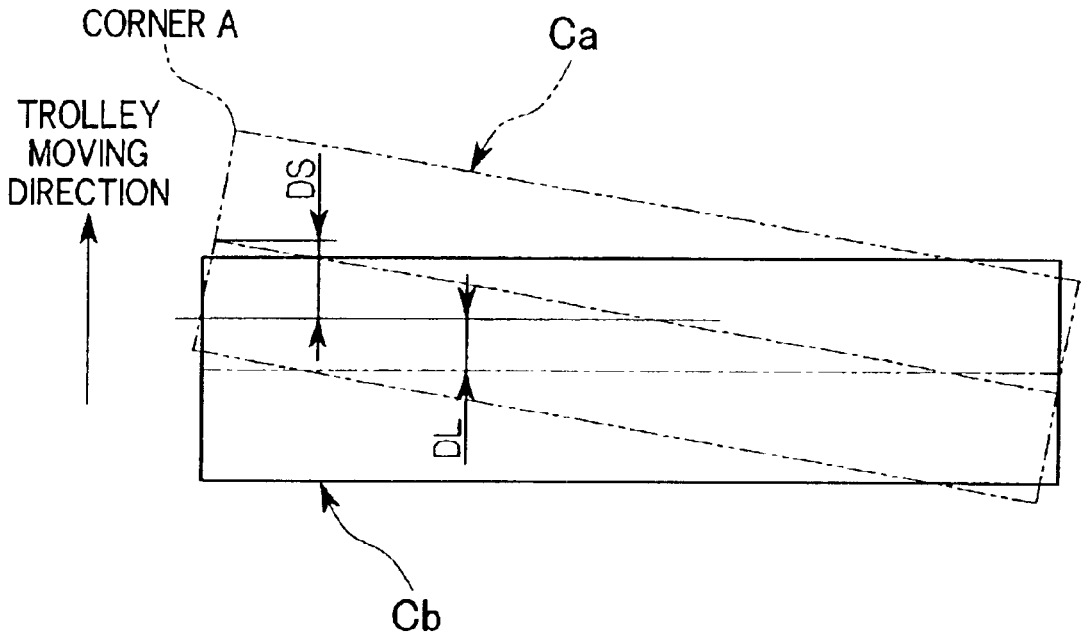
FIG. 5 is a diagram showing a schematic plane view for explaining horizontal positional displacement of a hoisted container with respect to a target container in a method for controlling a crane according to an embodiment of the present invention.

Here, it is possible to approximate the horizontal position displacement of the hoisted container Ca with respect to the target container Cb, considering the corner A of the hoisted container Ca, as shown in FIG. 5, by adding a positional displacement DL, which is parallel to the moving direction of the transverse trolley 13, to a positional displacement DS, which is a positional displacement of a moving direction component due to rotation.

Note that it is possible, in practice, to suppress the rotation movement to about 2° at most as mentioned above. Hence, assuming that the length of the container in the longitudinal direction (i.e., the length orthogonal to the moving direction of the transverse trolley 13) is 12 meters, the degree of shift of the container Ca due to rotation in the orthogonal direction with respect to the moving direction of the traverse trolley 13 becomes about 4 meters, and this can be neglected in practice. Accordingly, it is in practice appropriate to approximate the degree of movement due to the rotation using the moving direction component of the transverse trolley 13.

FIG. 4A is a diagram for explaining a control function with the purpose of correcting a horizontal position displacement between the hoisted container Ca and the target container Cb for the case where the corner A of the hoisted container Ca is lower in height relative to the height of the other corners B, C, and D in a state in which none of the corners A, B, C, and D of the container Ca has landed on the upper surface of the target container Cb.

As shown in FIG. 4A, the degree of positional displacement of the moving direction component of the transverse trolley 13, which is detected by the horizontal positional displacement detectors 20A and 20B for the corners A and B, respectively, is added as a trolley position correction signal to be used as a trolley position correction signal for the case where both of the corners A and B are displaced from the target container Cb, and is input to a regulator 28F via a control gain 28D or via the control gain 28D and a differentiating element 28E.

The horizontal position displacement correction unit 28B outputs a trolley speed command signal based on the trolley position correction signal input from the regulator 28F via the control gain 28D, and via the control gain 28D and the differentiating element 28E.

Also, the trolley position correction signal associated with the positional displacement of the corner A is input to the regulator 28F via a differentiating element 28C, and is controlled so as to decrease the positional displacement with respect to only the corner A by the operation of the differentiating element 28C after the trolley position correction control based on the degree of the positional displacement of the corner B is completed within a steady-state deviation which is determined by the control gain K.

In this manner, a control which focuses on the positional correction for the selected corner A is performed.

FIG. 4B is a diagram for explaining function for correcting the horizontal position displacement of the corner B of the container Ca with respect to the target container Cb after the corner A of the container Ca has landed on the target container Cb and while the landed state of the corner A is maintained.

That is, in FIG. 4B, the relationship between the corner A and the corner B in FIG. 4A is switched, and a control which focuses on the positional correction for the corner B is carried out as shown in FIG. 4B in the same manner as explained above for the operation shown in FIG. 4A.

The correction operation shown in FIG. 4B is configured so that it is carried out only when the corner A of the container Ca is in a landed state and the horizontal positional displacement between the corner A and the corresponding target container Cb is within the allowable range.

In this case, the degree of horizontal position displacement relating to the corner A is below a level which requires the trolley position correction control. Also, since the corner A does not move due to the contact with the target container Ca, the correction control shown in FIG. 4B becomes a control for correcting only the position of the corner B using the corner A as a supporting point.

Next, a stowage control using the crane 10 having the control system of the above-explained configuration will be explained in accordance with the flowcharts shown in FIGS. 6 and 7.

Figure 6:
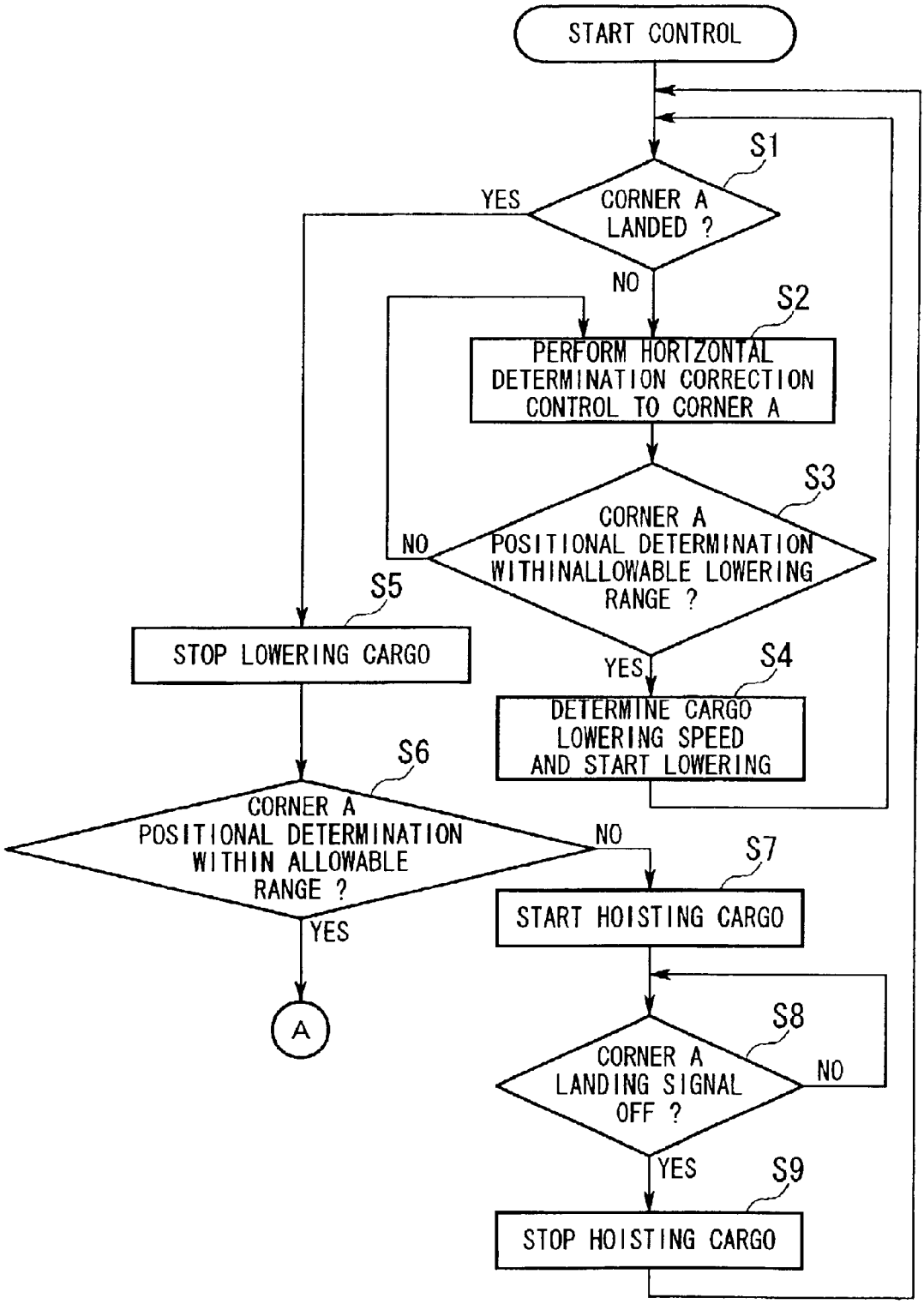
FIG. 6 is a flowchart for explaining a method for controlling a crane according to an embodiment of the present invention.
Figure 7:
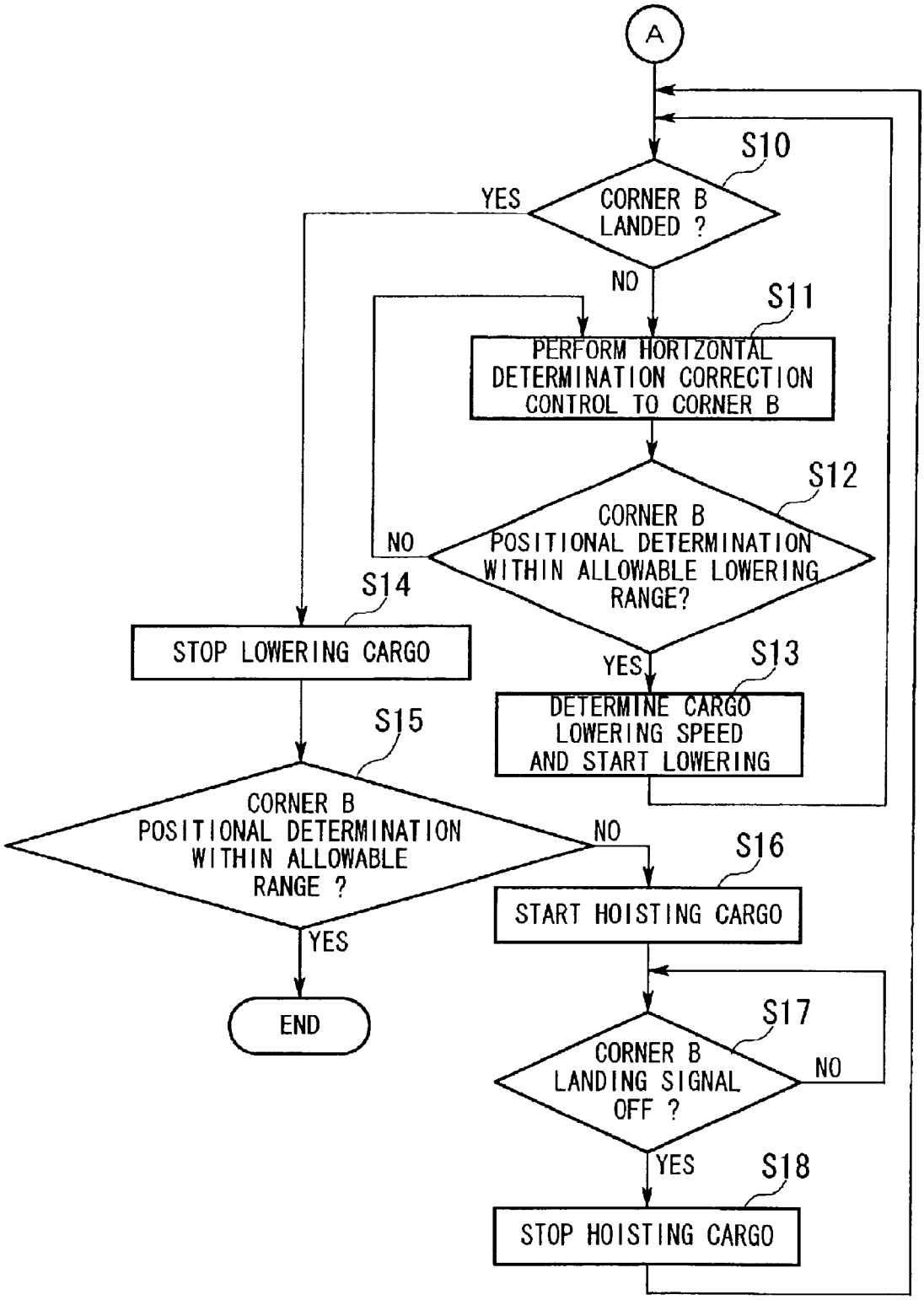
FIG. 7 is a flowchart for explaining a method for controlling a crane according to an embodiment of the present invention.

Note that steps S1–S9 shown in FIG. 6 indicate the flow of the landing control for the corner A of the hoisted container Ca, and steps S10–S18 shown in FIG. 7 indicate the flow of the landing control for the corner B (or other corners) of the hoisted container Ca.

Also, note that the landing control is started from a state in which none of the corners A, B, C, and D at the bottom of the hoisted container Ca have landed on the target container Cb, and the height of the corner A is set to be lower relative to the height of the other corners B, C, and D.

That is, prior to starting the control operation, only the corner A of the hoisted container Ca is set to be lower by changing the position of the supporting point of the rope member 15 on the transverse trolley 13 using the hanging member inclining devices 17 and 18 to incline the hanging member 16. In this manner, only the corner A is set to be lower than the other corners B, C, and D.

Also, as a method for setting the height of the corner A to be lower, it is possible to adjust the length of one of the rope members 15 be longer than the other three rope members 15 which are engaged with the respective corner of the hanging member 16.

In this embodiment, the hoisted container Ca is carried to the vicinity of the target container Cb by a normal operation control. In this case, although the meaning of the term "vicinity of the target container" depends on such factors as the size of the container, it is possible to assume about 0.5 m for the vertical distance and about 0.2 m for the horizontal position displacement between the bottom surface of the hoisted container Ca and the upper surface of the target container Cb for an ISO standard marine container. However, these settings may vary depending on the situation.

Steps S1–S9 in the landing control process for the corner A:

Step S1:

First, it is determined if the lower end of the corner A has landed on the target container Cb based on a detection signal from the landing detector 23A which corresponds to the corner A of the hoisted container Ca.

That is, if the corner A has not landed, the other corners B, C, and D have also not landed, and hence, there is space between the container Ca and the target container Cb.

Figure 8:
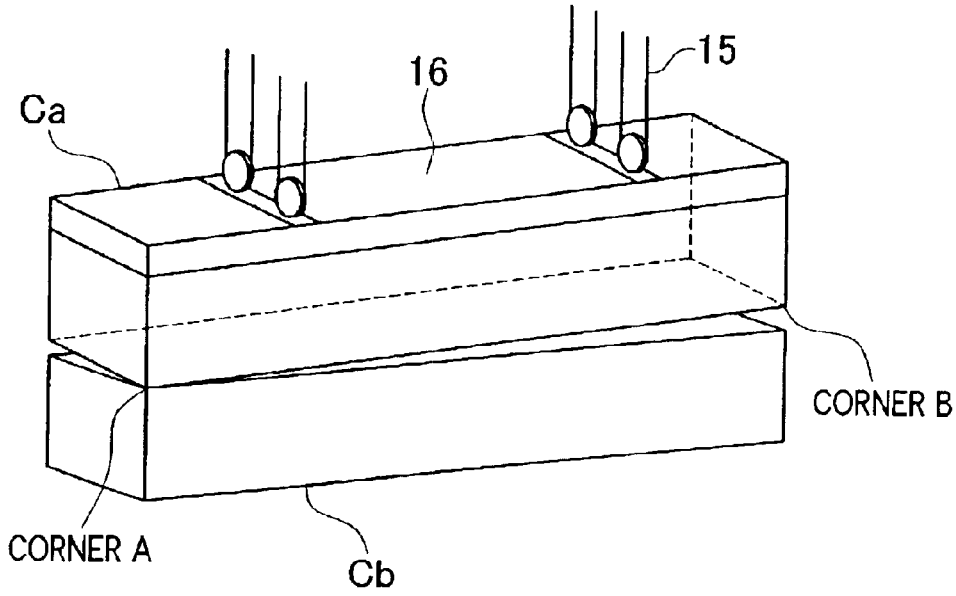
FIG. 8 is a diagram showing a schematic perspective view of a target container and a hoisted container for explaining a method for controlling a crane according to an embodiment of the present invention.

Step S2:

As shown in FIG. 8, the horizontal position displacement correction control for the corner A shown in FIG. 4A is carried out in a state where the lower end of the corner A of the hoisted container Ca has landed on the target container Cb.

That is, based on signals from the horizontal position displacement detectors 20A and 20B, and from the trolley position detector 26A and the trolley speed detector 26B, the horizontal position displacement correction unit 28B of the stowage control unit 32 outputs a trolley speed command signal to the trolley motor driving device 31 A to actuate the trolley driving motor 31 so that the corner A of the hoisted container Ca matches the corner A of the target container Cb.

In this manner, the transverse trolley 13 is actuated, and the corner A of the hoisted container Ca approaches the corner A of the target container Cb.

Step S3:

The horizontal position displacement determination unit 28A of the stowage control unit 32 determines whether the positional displacement of the corner A of the hoisted container Ca with respect to the corner A of the target container Cb is within a predetermined allowable range from which the lowering of the hoisted container Ca can start.

At this time, if the positional displacement is not within the allowable range, the horizontal position displacement correction control (step S2) by the horizontal position displacement correction unit 28B of the stowage control unit 32 is carried out.

Step S4:

If the positional displacement between the corner A of the hoisted container Ca and the corner A of the target container Cb is within the allowable range from which the hoisted container Ca may be lowered, a signal is transmitted to the hoisted cargo lowering speed determination unit 27A from the horizontal position displacement determination unit 28A so that the hoisted cargo lowering speed determination unit 27A determines the lowering speed for the hoisted container Ca and outputs a signal to the hoisted cargo lowering timing determination unit 27B in order to determine the timing for starting to lower the container Ca by the hoisted cargo lowering timing determination unit 27B. Also, a control signal is output to the hoisting motor driving device 30A at the start of the lowering the container Ca to actuate the hoisting motor 30. In this manner, the lowering of the container Ca start, at the speed determined by the hoisted cargo lowering speed determination unit 27A.

Note that the lowering speed determined by the hoisted cargo lowering speed determination unit 27A may be set to be a maximum speed at which the impact generated by the landing of the hoisted container Ca on the target container Cb falls within an allowable range. Also, the timing determined by the hoisted cargo lowering timing determination unit 27B is set to be a timing at which the positional displacement of the corner A enters a predetermined allowable range.

Thereafter, it is determined whether the lower end of the corner A has landed on the target container Cb (step S1) based on the detection signal from the landing detector 23A corresponding to the corner A of the hoisted container Ca.

Step S5:

When the signal from the landing detector 23A is input to the hoisted cargo lowering stop determination unit 27C of the stowage control unit 32, the hoisted cargo lowering stop determination unit 27C outputs a control signal to the hoisting motor driving device 30A to stop the actuation of the hoisting motor 30 so that the lowering of hoisted cargo Ca is stopped.

Step S6:

If it is determined that the positional displacement of the corner A of the hoisted container Ca with respect to the corner A of the target container Cb is within a predetermined allowable range by the horizontal position displacement determination unit 28A of the stowage control unit 32, landing operations (steps S10–18) for the other corners B, C, and D are subsequently carried out.

Step S7:

If it is determined that the positional displacement of the corner A is not within the allowable range by the horizontal position displacement determination unit 28A, the hoisting motor 30 is actuated by the hoisting motor driving device 30A so that the hoisted container Ca is raised.

Step S8:

It is determined whether the corner A of the hoisted container Ca is separated from the target container Cb based on a signal from the landing detector 20A for the corner A of the hoisted container Ca.

Step S9:

If it is determined that the corner A of the hoisted container Ca is detached from the target container Cb, the hoisting motor 30 is stopped by the hoisting motor driving device 30A.

After this, the landing control process for the corner A (i.e., the control process of step S1 and thereafter) is carried out again.

Steps S10–S18 in the landing control process for the corner B:

Step S10:

It is determined whether the lower end of the corner B has landed on the target container Cb based on the detection signal from the landing detector 23B corresponding to the corner B of the hoisted container Ca.

Note that since this step is continued from step S6, only the corner A has landed on the target container Cb and the other corners B, C, and D have not landed when this step is carried out for the first time.

Step S11:

The horizontal position displacement correction control for the corner B, as shown in FIG. 4B, is carried out in a state where the lower end of the corner A of the hoisted container Ca has landed on the target container Cb.

That is, based on signals from the horizontal position displacement detectors 20A and 20B, and from the trolley position detector 26A and the trolley speed detector 26B, the horizontal position displacement correction unit 28B of the stowage control unit 32 outputs a trolley speed command signal to the trolley motor driving device 31A to actuate the trolley driving motor 31 so that the corner B of the hoisted container Ca lands on the corner B of the target container Cb.

In this manner, the transverse trolley 13 is actuated, and the corner B of the hoisted container Ca approaches the corner B of the target container Cb.

Step S12:

The horizontal position displacement determination unit 28A of the stowage control unit 32 determines whether the positional displacement of the corner B of the hoisted container Ca with respect to the corner B of the target container Cb is within a predetermined allowable range from which the lowering of the hoisted container Ca can start.

At this time, if the positional displacement is not within the allowable range, the horizontal position displacement correction control (step S11) by the horizontal position displacement correction unit 28B of the stowage control unit 32 is carried out.

Step S13:

If the positional displacement between the corner B of the hoisted container Ca and the corner B of the target container Cb is within the allowable range from which the hoisted container Ca may be lowered, a signal is transmitted to the hoisted cargo lowering speed determination unit 27A from the horizontal position displacement determination unit 28A so that the hoisted cargo lowering speed determination unit 27A determines the lowering speed for the hoisted container Ca and outputs a signal to the hoisted cargo lowering timing determination unit 27B in order to determine the timing for starting to lower the container Ca by the hoisted cargo lowering timing determination unit 27B. Also, a control signal is output to the hoisting motor driving device 30A at the start of the lowering of the container Ca to actuate the hoisting motor 30. In this manner, the lowering of the container Ca is started at the speed determined by the hoisted cargo lowering speed determination unit 27A.

Note that the lowering speed determined by the hoisted cargo lowering speed determination unit 27A may be set to be a maximum speed at which impact generated by the landing of the hoisted container Ca on the target container Cb would fall within the allowable range. Also, the timing determined by the hoisted cargo lowering timing determination unit 27B is set to be the timing at which the positional displacement of the corner B enters a preset allowable range.

Thereafter, it is determined whether the lower end of the corner B has landed on the target container Cb (step S10) based on the detection signal from the landing detector 23B corresponding to the corner B of the hoisted container Ca.

Step S14:

When the signal from the landing detector 23B is input to the hoisted cargo lowering stop determination unit 27C of the stowage control unit 32, the hoisted cargo lowering stop determination unit 27C outputs a control signal to the hoisting motor driving device 30A to stop the actuation of the hoisting motor 30 by the hoisting motor driving device 30A so that the hoisted cargo Ca stops being lowered.

Step S15:

If it is determined that the positional displacement of the corner B of the hoisted container Ca with respect to the corner B of the target container Cb is within a predetermined allowable range by the horizontal position displacement determination unit 28B of the stowage control unit 32, the landing operations are completed with the recognition that each of the corners A–D matches with the corresponding corner of the upper surface of the target container Cb in a highly accurate manner.

Step S16:

If it is determined that the positional displacement of the corner B is not within the allowable range by the horizontal position displacement determination unit 28A, the hoisting motor 30 is actuated by the hoisting motor driving device 30A so that the hoisted container Ca is raised.

Step S17:

It is determined whether the corner B of the hoisted container Ca is detached from the target container Cb based on a signal from the landing detector 20A for the corner B of the hoisted container Ca.

Step S18:

If it is determined that the corner B of the hoisted container Ca has separated from the target container Cb, the hoisting motor 30 is stopped by the hoisting motor driving device 30A.

After this, the landing control for the corner B (i.e., the control of step S10 and thereafter) is carried out again.

Accordingly, the container Ca can be landed on the target container Cb in a highly accurate manner within a short period of time by the above-mentioned landing control process of steps S1–S18.

Note that although the determination of whether the corner B of the container Ca is separated from the target container Cb, i.e., whether the corners B, C, and D, other than the corner A have been raised, is made based on the signal from the landing detector 20B provided with the hanging member 16 in step S17 in the embodiment explained above, it is possible to carry out the determination process without using the landing detector 20B.

As a means for making the determination, for example, it is possible to provide a sensor, such as a CCD camera, for detecting the movement of the hanging member 16 in order to detect subtle positional shifts of the hoisted container Ca caused by a horizontal position displacement between the rope supporting point on the transverse trolley 13 and the rope supporting point on the hanging member 16 when the container Ca is hoisted by the hoisting device 14 and the corners B, C, and D, other than the corner A, are separated from the target container Cb in a state where the positional displacement is caused between the hoisting point on the rope member 15 on the trolley 13 and the supporting point of the rope member 15 at the hanging member 16 side, i.e., the point at which the rope member 15 is connected to the hanging member 16, by slightly moving the transverse trolley 13 in the horizontal direction, for example, when all of the corners A–D are landed on the target container Cb. In this manner, it becomes possible to prevent an increase in the raising height, and maintain the raising height as small as possible as compared with the case where a landing detector including a limit switch is used. Accordingly, time required for carrying out the alignment control process, which is performed subsequently, can be significantly reduced.

Figure 9:
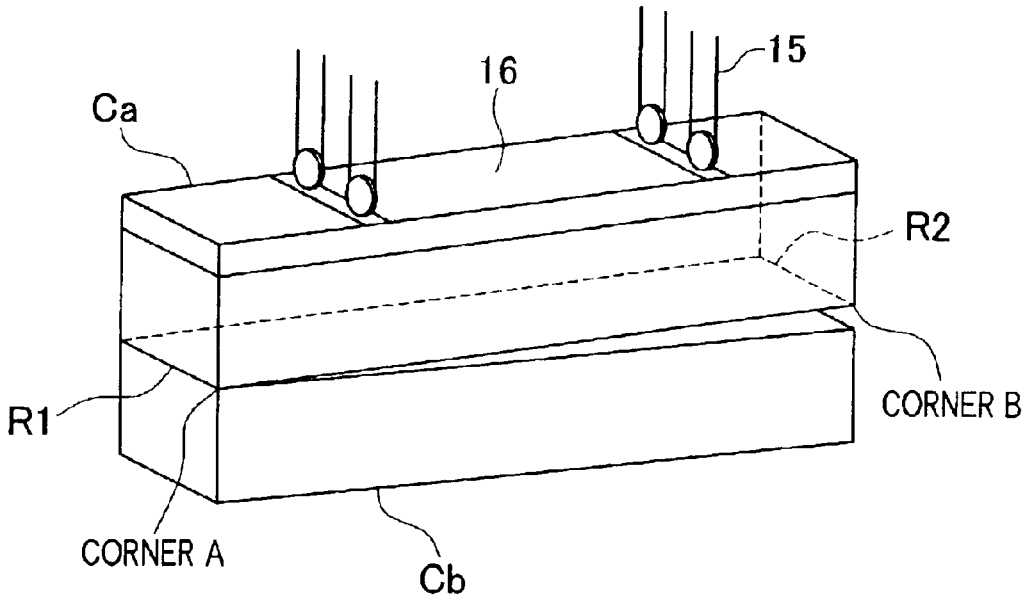
FIG. 9 is a diagram showing a schematic perspective view of a target container and a hoisted container for explaining a method for controlling a crane according to another embodiment of the present invention.
Figure 10:
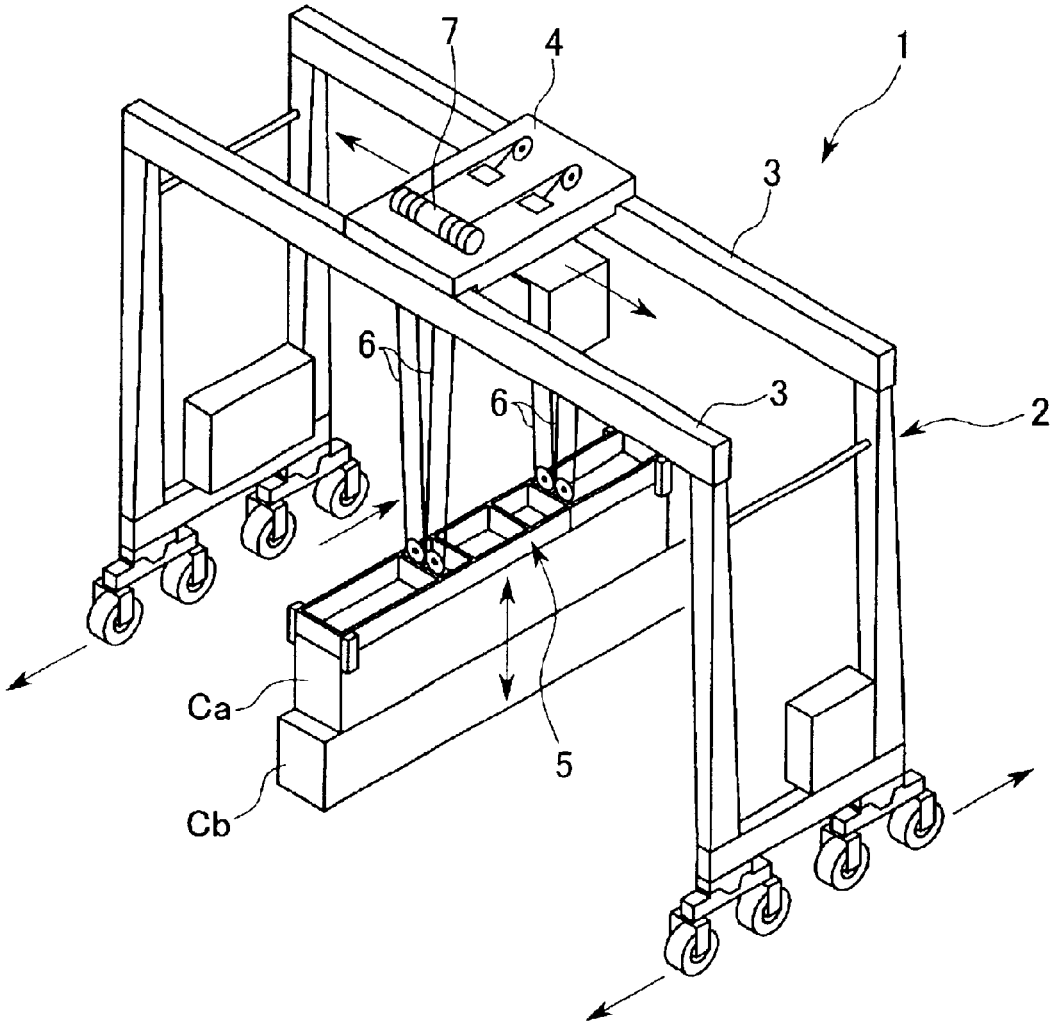
FIG. 10 is a diagram showing a perspective view of a crane to explain a structure and elements of a general transfer crane.

Note that although the other corner (i.e., the corner B) of the container Ca is positioned and landed on the target container Cb after the corner A of the container Ca is positioned and landed on the target container Cb in the above-explained embodiment, it is possible that one of the short sides, R1, of the hoisted container Ca be lowered first, as shown in FIG. 9, and in this state the side R1 may be landed on the target container Cb. After this, the other short side R2 of the container Ca is landed on the target container Cb to perform a landing operation with high accuracy.

In the above landing control process, the side R1 is landed on the target container Cb while the corner A on one end of the side R1 is positioned in accordance with the landing control process for the corner A as described above. Then, the side R2 is landed on the target container Cb while the corner B on the other end of the side R1 is positioned in accordance with the landing control process for the corner B described above.

Also, although an explanation is given for the case where the hoisted container Ca lands on a target container Cb in the embodiment described above, it is of course possible to apply the present invention to the case where the container Ca is stowed in a position related to a landing spot on the floor of a container stowage area.

Note that it is necessary, when the container has landed on the floor of the container stowage area, to provide a means for detecting a horizontal position displacement between the hoisted container Ca and the predetermined position on the floor as well as a means for detecting horizontal position displacement between the hoisted container Ca and the target container Cb. It is of course possible to employ the horizontal position displacement detectors 20A–20D, which are used when the container Ca lands on the target container Cb, as the means for detecting the horizontal position displacement.

Also, although the corner B adjacent to the corner A of the container Ca lands on the target container Cb while determining the position thereof after the position of the corner A is determined in the embodiment explained above, the corner whose position is determined after the corner A is not limited to the corner B, and can be the corner C or D.

Moreover, although the landing detectors 23B, 23C, and 23D, and the horizontal position displacement detectors 20B, 20C, and 20D, respectively, are provided for all of the other corners B, C, and D in the embodiment described above, the above-mentioned landing control process can be appropriately carried out if the detectors are provided on only one of the corners B, C, and D, other than the corner A.

According to the crane and the method for controlling the crane in the above embodiment of the present invention, the following effects can be obtained since the control is performed by considering only the horizontal position displacement between the corner A of hoisted container Ca and the corner A of the target container Cb, which is a predetermined position for the landing place, and the whole container Ca lands on the target container Cb by performing the positioning control on the corner B after the corner A has landed.

(1) the hoisted container Ca may be stowed on a landing place or landed on the target container Cb by securely carrying out a positioning in the horizontal direction without using any additional equipment, such as a special mechanical guide, even when the hoisted container Ca is moved in the moving direction of the transverse trolley 13 and is rotated.

(2) the hoisted container Ca may be stowed on a landing place or landed on the target container Cb within a short period of time without the need for attachment of a special device for the crane 10 and without the need for waiting for the movement of the container Ca to stop even when the hoisted container Ca is moved in the moving direction of the transverse trolley 13 and is rotated.

(3) the hoisted container Ca may be stowed on a landing place or landed on the target container Cb in a stable manner without being affected by errors in positional estimation due to disturbances, such as wind and offset load of the hoisted cargo, in a landing control method of a positional estimation of the hoisted container The above effects are extremely effective in realizing a stable and efficient automated stowage system for the crane 10 at low cost.

Having thus described several exemplary embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the invention is limited and defined only by the following claims and equivalents thereto.

What is claimed is:

1. A crane provided with a trolley which is supported in a horizontally movable manner, a hanging member which is hung from the trolley via a rope member and supports a cargo, and a hoisting device which raises and lowers the hanging member by winding and unwinding the rope member, said crane being used to land the cargo supported by the hanging member at a predetermined landing place, comprising:

a horizontal position displacement detection unit which detects a horizontal positional displacement between at least two corners, including a first corner and a second corner, of the cargo and a position relating to the landing place of each of the first corner and the second corner;

a horizontal position displacement correction unit which corrects a horizontal positional displacement between the at least two corners, the first corner and the second corner, of the cargo and the position relating to the landing place of each of the first corner and the second corner when the first corner and the second corner, respectively, land based on a detection signal from said horizontal position displacement detection unit, a horizontal position displacement determination unit which determines if the horizontal positional displacement between the first corner and the second corner is within an allowable range;

a hoisted cargo lowering speed determination unit which determines a lowering speed of the cargo when the horizontal positional displacement determined by the horizontal position displacement determination unit is within the allowable range; and a hoisted cargo lowering timing determination unit which determines a timing for starting to lower the cargo at the lowering speed determined by the hoisted cargo lowering speed determination unit; wherein the first corner of the cargo lands at the landing place of the first corner, and then the second corner lands at the landing place of the second corner.

2. A crane provided with a trolley which is supported in a horizontally movable manner, a hanging member which is hung from the trolley via a rope member and supports a cargo, and a hoisting device which raises and lowers the hanging member by winding and unwinding the rope member, said crane being used to land the cargo supported by the hanging member at a predetermined landing place, comprising:

a horizontal position displacement detection unit which detects a horizontal positional displacement between at least two corners, including a first corner and a second corner, of the cargo and a position relating to the landing place of each of the first corner and the second corner;

a horizontal position displacement correction unit which corrects a horizontal positional displacement between the at least two corners, the first corner and the second corner, of the cargo and the position relating to the landing place of each of the first corner and the second corner when the first corner and the second corner, respectively, land based on a detection signal from said horizontal position displacement detection unit, a horizontal position displacement determination unit which determines if the horizontal positional displacement between the first corner and the second corner is within an allowable range;

a hoisted cargo lowering speed determination unit which determines a lowering speed of the cargo when the horizontal positional displacement determined by the horizontal position displacement determination unit is within the allowable range; and a hoisted cargo lowering timing determination unit which determines a timing for starting to lower the cargo at the lowering speed determined by the hoisted cargo lowering speed determination unit; wherein a side including the first corner of the cargo lands at the landing place of the first corner, and then another side including the second corner lands at the landing place of the second corner.

3. A method for controlling a crane provided with a trolley which is supported in a horizontally movable manner, a hanging member which is hung from the trolley via a rope member and supports a cargo, and a hoisting device which raises and lowers the hanging member by winding and unwinding the rope member, the crane being used to land the cargo supported by the hanging member at a predetermined landing place, comprising the steps of:

a lowering step in which one of the corners, including a first corner, of the cargo supported by the hanging member is lowered relative to the other corners of the cargo by inclining the hanging member;

a first positioning step in which the horizontal position of the first corner is determined with respect to a position relating to the landing place of the first corner;

wherein the first positioning step further comprises determining if a horizontal positional displacement between the first corner and the position relating to the landing place of the first corner is within an allowable range, determining a lowering speed of the cargo when the horizontal positional displacement is within the allowable range, and determining a first timing for starting to lower the cargo at the lowering speed;

a first landing step in which the first corner is made to contact the landing place by lowering the cargo using the hoisting device in a state where the first corner is positioned at the position relating to the landing place of the first corner;

a second positioning step in which the horizontal position of at least one corner other than the first corner, including a second corner, of the cargo is determined with respect to a position relating to the landing place of the second corner after the first landing step;

wherein the second positioning step further comprises determining if a horizontal positional displacement between the second corner and the position relating to the landing place of the second corner is within the allowable range, determining a lowering speed of the cargo when the horizontal positional displacement is within the allowable range, and determining a second timing for starting to lower the cargo at the lowering speed; and a second landing step in which corners other than the first corner including the second corner are made to contact the landing place by lowering the cargo using the hoisting device in a state where the second corner is positioned with respect to the position relating to the landing place of the second corner so that the entire bottom surface of the cargo lands on the landing place.

4. A method for controlling a crane according to claim 3, wherein the landing place is an upper surface of a container and the cargo is landed and stowed on the container.

5. A method for controlling a crane provided with a trolley which is supported in a horizontally movable manner, a hanging member which is hung from the trolley via a rope member and supports a cargo, and a hoisting device which raises and lowers the hanging member by winding and unwinding the rope member, the crane being used to land the cargo supported by the hanging member at a predetermined landing place, comprising the steps of:

a lowering step in which one of the sides including a first corner of the cargo supported by the hanging member is lowered relative to the other sides of the cargo by inclining the hanging member;

a first positioning step in which the horizontal position of the first corner is determined with respect to a position relating to the landing place of the first corner;

wherein the first positioning step further comprises determining if a horizontal positional displacement between the first corner and the position relating to the landing place of the first corner is within an allowable range, determining a lowering speed of the cargo when the horizontal positional displacement is within the allowable range, and determining a first timing for starting to lower the cargo at the lowering speed;

a first landing step in which the side including the first corner is made to contact the landing place by lowering the cargo using the hoisting device in a state where the first corner is positioned at the position relating to the landing place of the first corner;

a second positioning step in which the horizontal position of another side, including a second corner, opposite the side including the first corner, of the cargo is determined with respect to a position relating to the landing place of the second corner after the first landing step;

wherein the second positioning step further comprises determining if a horizontal positional displacement between the second corner and the position relating to the landing place of the second corner is within the allowable range, determining a lowering speed of the cargo when the horizontal positional displacement is within the allowable range, and determining a second timing for starting to lower the cargo at the lowering speed; and a second landing step in which the side including the second corner of the cargo is made to contact the landing place by lowering the cargo using the hoisting device in a state where the second corner is positioned with respect to the position relating to the landing place of the second corner so that the entire bottom surface of the cargo lands on the landing place.

6. A method for controlling a crane according to claim 5, wherein the landing place is an upper surface of a container and the cargo is landed and stowed on the container.

7. A method for controlling a crane provided with a trolley which is supported in a horizontally movable manner, a hanging member which is hung from the trolley via rope members and supports a cargo, and a hoisting device which raises and lowers the hanging member by winding and unwinding the rope members, the crane being used to land the cargo supported by the hanging member at a predetermined landing place, comprising the steps of:

an adjusting step in which the length of the rope members is adjusted so that a first corner of the cargo supported by the hanging member is lowered relative to corners other than the first corner of the cargo when the cargo is hoisted by using the hoisting device;

a hoisting step in which the corners of the cargo other than the first corner are separated from a place where the cargo has been placed by winding the hanging member using the hoisting device;

a positioning step in which a horizontal position of at least one of the other corners, including a second corner, of the cargo is determined with respect to a position relating to the landing place of the second corner after the hoisting step;

wherein the positioning step further comprises steps of determining if the horizontal position is within an allowable range, determining a lowering speed of the cargo when the horizontal position is within the allowable range, and determining a timing for starting to lower the cargo at the lowering speed; and a landing step in which the corners other than the first corner including the second corner are made contact with the landing place by lowering the cargo using the hoisting device in a state where the second corner is positioned with respect to the position relating to the landing place of the second corner so that the entire bottom surface of the cargo lands on the landing place.

8. A method for controlling a crane according to claim 7, further comprising the steps of:

a positional displacement step in which a rope member supporting point on the trolley and a rope member supporting point on the hanging member are horizontally shifted prior to the hoisting step; and a hoisting stop step in which the hoisting of the hanging member is stopped when the movement of the cargo due to a horizontal positional shift of the rope supporting points is detected in the hoisting step.

9. A method for controlling a crane according to claim 8, wherein the landing place is an upper surface of a container and the cargo is landed and stowed on the container.

10. A method for controlling a crane according to claim 7, wherein the landing place is an upper surface of a container and the cargo is landed and stowed on the container.

11. A method for controlling a crane provided with a trolley which is supported in a horizontally movable manner, a hanging member which is hung from the trolley via rope members and supports a cargo, and a hoisting device which raises and lowers the hanging member by winding and unwinding the rope members, the crane being used to land the cargo supported by the hanging member at a predetermined landing place, comprising the steps of:

an adjusting step in which the length of the rope members is adjusted so that one of the sides including a first corner of the cargo supported by the hanging member is lowered relative to other sides of the cargo when the cargo is hoisted by using the hoisting device;

a hoisting step in which another side of the cargo, including a second corner, which opposes the side including the first corner is separated from a place where the cargo has been placed by winding the hanging member using the hoisting device;

a positioning step in which a horizontal position of the second corner of the side of the cargo separated from the place where the cargo has been placed is determined with respect to a position relating to the landing place of the second corner after the hoisting step;

wherein the positioning step further comprises steps of determining if the horizontal position is within an allowable range, determining a lowering speed of the cargo when the horizontal position is within the allowable range, and determining a timing for starting to lower the cargo at the lowering speed; and a landing step in which the side including the second corner of the cargo is made to contact the landing place by lowering the cargo using the hoisting device in a state where the second corner is positioned with respect to the position relating to the landing place of the second corner so that the entire bottom surface of the cargo lands on the landing place.

12. A method for controlling a crane according to claim 11, further comprising the steps of:

a positional displacement step in which a rope member supporting point on the trolley and a rope member supporting point on the hanging member are horizontally shifted prior to the hoisting step; and a hoisting stop step in which the hoisting of the hanging member is stopped when the movement of the cargo due to a horizontal positional shift of the rope supporting points is detected in the hoisting step.

13. A method for controlling a crane according to claim 11, wherein the landing place is an upper surface of a container and the cargo is landed and stowed on the container.

* * * * *